United States Patent [19]

Ward

[11] 4,175,451

[45] Nov. 27, 1979

[54] GUIDANCE SYSTEM USING SPRING-STORED ENERGY

[75] Inventor: Frederick D. Ward, Quebec, Canada

[73] Assignee: Her Majesty the Queen in right of Canada, as represented by the Minister of National Defence, Quebec, Canada

[21] Appl. No.: 853,857

[22] Filed: Nov. 22, 1977

[30] Foreign Application Priority Data

Dec. 17, 1976 [CA] Canada ..... 268087

[51] Int. Cl.[2] ..... F16H 1/00

[52] U.S. Cl. ..... 74/661; 74/665 A; 74/713; 185/10

[58] Field of Search ..... 74/417, 661, 665 A, 74/713; 244/76 A, 177; 185/10

[56] References Cited

U.S. PATENT DOCUMENTS

| | | | |
|---|---|---|---|
| 3,156,436 | 11/1964 | White | 244/177 X |
| 3,220,672 | 11/1965 | Moller | 244/177 X |
| 3,240,447 | 3/1966 | Olshausen | 244/177 |
| 3,470,765 | 10/1969 | Campbell | 74/417 X |
| 3,636,324 | 1/1972 | Dommasch | 244/177 X |
| 3,833,189 | 9/1974 | Fowler et al. | 244/177 |

*Primary Examiner*—William F. O'Dea
*Assistant Examiner*—Harold Joyce

[57] ABSTRACT

A spring actuated differential mechanism for controlling the angular position of one or more vanes which is particularly suitable for use in a guidance system for a guided weapon. A pair of vanes are mounted on an axle and a bevel differential is mounted centrally between them. The pivots of one set of bevels is normal to and solid with the vane axle and meshing therewith is a second set of bevels coaxial with but free on the vane axle. Each bevel of the second set of bevels is connected to one of a pair of large pinion gears which are induced to turn in opposite directions by an associated coil spring. Each of these pinion meshes with a small pinion, rotation of which is governed by a low power solenoid controlled escapement. Momentary energization of one solenoid permits a desired rotation of the associated escapement and a correspondingly smaller rotation of the associated large pinion and bevel. Because the other large pinion and its associated bevel are locked by their associated escapement, the meshing bevels of the first set rotate around the stationary bevels by an amount equal to one half of the rotation of the large pinion, thus inclining the vanes and their associated axle. Energization of the other solenoid effects a similar movement of the vanes but in the opposite direction. Two sets of vanes at right angles in the same axial plane can also be controlled by vesting two differential mechanisms, from each of which one gear has been eliminated, at right angles one within the other.

27 Claims, 7 Drawing Figures

GUIDANCE SYSTEM USING SPRING-STORED ENERGY

This invention relates generally to a spring actuated device for controlling the angular position of one or more vanes and more particularly to a spring actuated vane guidance system which has a low power demand.

In guidance systems, for guided weapons and the like, a pair of axially rotatable vanes are generally provided in each of two planes at right angles in order to deflect air flow as required to achieve controlled movement of the weapon. The vanes are generally actuated by pistons operated by stored or generated gas or by hydraulic pressure. Alternatively, direct electro magnetic force from solenoids may be employed. Such systems are generally not only bulky, complicated and relatively expensive, but also have various specific undesirable characteristics. Pistons require intermediary control valves which in turn tend to require heavy electric currents for operation. Stored gas is often difficult to provide in the available space and is otherwise undesirable, while generated gas tends to complicate valve design due to the high temperatures and combustion products generally involved. In order to operate solenoids relatively heavy currents are generally required and these are frequently difficult to obtain from batteries, which may of themselves be bulky, or which have been cold soaked during air transportation. Furthermore, the amplification of minute signals from a target sensor may be complicated if not impossible if the solenoid actuation currents are large. The prior art systems described herein above also have the disadvantage that they are generally only suited to a "bang-bang" operation mode in which the guidance vanes are in continual movement from full lock to full lock, causing the missile or other controlled device to hunt around its mean path. An intermediate neutral position of vanes can only be achieved at the expense of further complications.

It is an object of the present invention to provide a relatively inexpensive and compact device in which control vanes can be powered by stored energy in spirally wound springs and actuated by momentary energizing of a low power solenoid.

Thus, by one aspect of this invention, there is provided a device for controlling the angular position of a vane comprising: (a) a first shaft; (b) a second shaft normal to and solid with said first shaft; (c) a vane secured adjacent one end of said first shaft; (d) a differential gear arrangement having a first pair of gears rotatably mounted on said first shaft and a second pair of gears meshing with said first pair of gears and rotatably mounted on said second shaft; (e) drive means drivingly connected to one gear of said first pair of gears; (f) motor means drivingly connected to said drive means to drive the same; (g) means selectively operable to effect incremental movement of the drive means; and (h) brake means associated with the second gear of said first pair of gears to arrest the same, whereby incremental movement of said drive means causes a change in the angular position of said vane.

By a preferred aspect of this invention, there is provided a device for controlling the angular position of a vane comprising: (a) a first shaft; (b) a second shaft normal to and solid with said first shaft; (c) a vane secured adjacent one end of said first shaft; (d) a differential gear arrangement having a first pair of gears rotatably mounted on said first shaft and a second pair of gears meshing with said first pair of gears and rotatably mounted on said second shaft; (e) drive means drivingly connected to each gear of said first pair of gears; (f) motor means drivingly connected to each of said drive means to drive the same; (g) a pair of driven means each operatively connected to a respective said drive means and to a respective remotely actuable escapement so as to effect incremental movement of a selected one of said driven means while arresting movement in the other said driven means, to thereby effect an incremental movement in one of said drive means and cause a change in the angular position of said vane.

By yet another aspect of this invention, there is provided a device for controlling angular position of a vane comprising: a first shaft; a vane secured adjacent each end of said first shaft; a second shaft normal to and solid with said first shaft; a first pair of bevel gears rotatably mounted on said first shaft; a second pair of bevel gears rotatably mounted on said second shaft and meshing with said first pair of bevel gears so as to provide a differential; first and second pinion gears axially mounted on said first shaft, each abutting a respective bevel gear of said first pair of bevel gears and rotatable therewith; spring means operatively connected to said first and second pinion gears to effect rotation thereof in opposite angular directions; axially mounted first and second escapement means; third and fourth pinion gears axially mounted and rotatable with said first and second escapement means respectively and meshing with said first and second pinion gears respectively; and solenoid means adjacent each said escapement means for selective engagement with and release from a respective escapement to thereby permit incremental movement of a selected one of said first and second pinion gears and thus causes a change in the angular position of said first shaft and its associated vanes.

By a further aspect of this invention, there is provided a device for controlling the angular position of at least two vanes mounted at right angles in the same axial plane, comprising: first and second vane control mechanisms adapted to be contained within a single housing, each said mechanism comprising:

(a) a first shaft;

(b) a second shaft normal to and solid with said first shaft;

(c) a vane secured adjacent at least one end of said first shaft;

(d) a differential gear arrangement having a pair of gears rotatably mounted on said first shaft and a gear meshing with said pair of gears and rotatably mounted on said second shaft;

(e) drive means drivingly connected to at least one gear of said pair of gears;

(f) motor means drivingly connected to each said drive means to drive the same;

(g) means selectively operable to effect incremental movement of the drive means; and (h) brake means associated with the second gear of said pair of gears to arrest the same, whereby incremental movement of said drive means causes a change in the angular position of said vane; wherein said first shaft of said first mechanism includes a U-shaped recess between said pair of gears mounted thereon and said first shaft of said second mechanism includes a U-shaped portion between said pair of gears mounted thereon adapted for a loose abutting relationship in said U-shaped recess when said first shafts of said first and second mechanisms are at right angles to each other, thereby permitting limited angular relative movement at right angles between said first and second mechanisms, and wherein said gears of said second mechanism are relatively smaller than said gears of said first mechanism such that said gears of said second mechanism nest within an area bounded by the gears of said first mechanism.

The invention will be described in more detail hereinafter with reference to the accompanying drawings in which.

Figure 4:
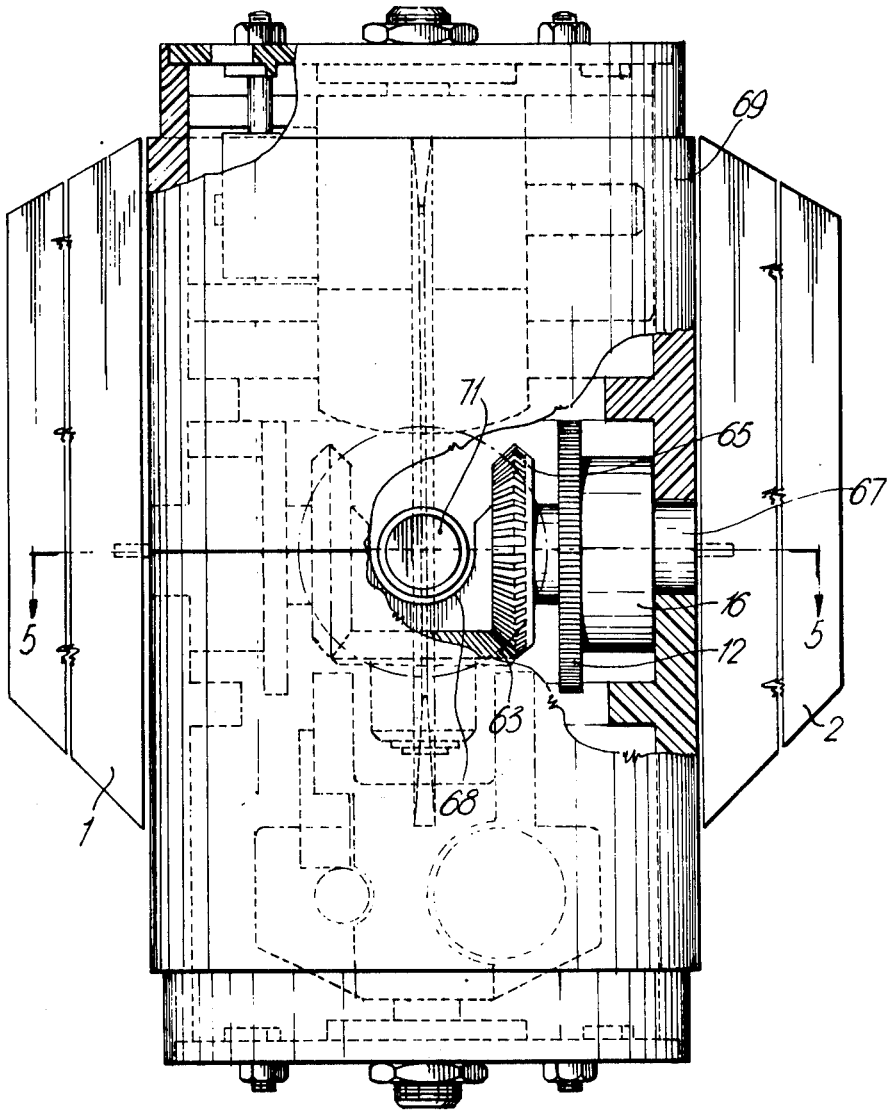
FIG. 4 is a side view, partly in section, of an alternative embodiment of this invention wherein two sets of vanes and gears are nested.

FIGS. 6(*a*) and (*b*) are exploded isometric views of the embodiment of FIG. 4 showing how the two sets of gears and vanes are nested.

Figures 1, 2, 3:
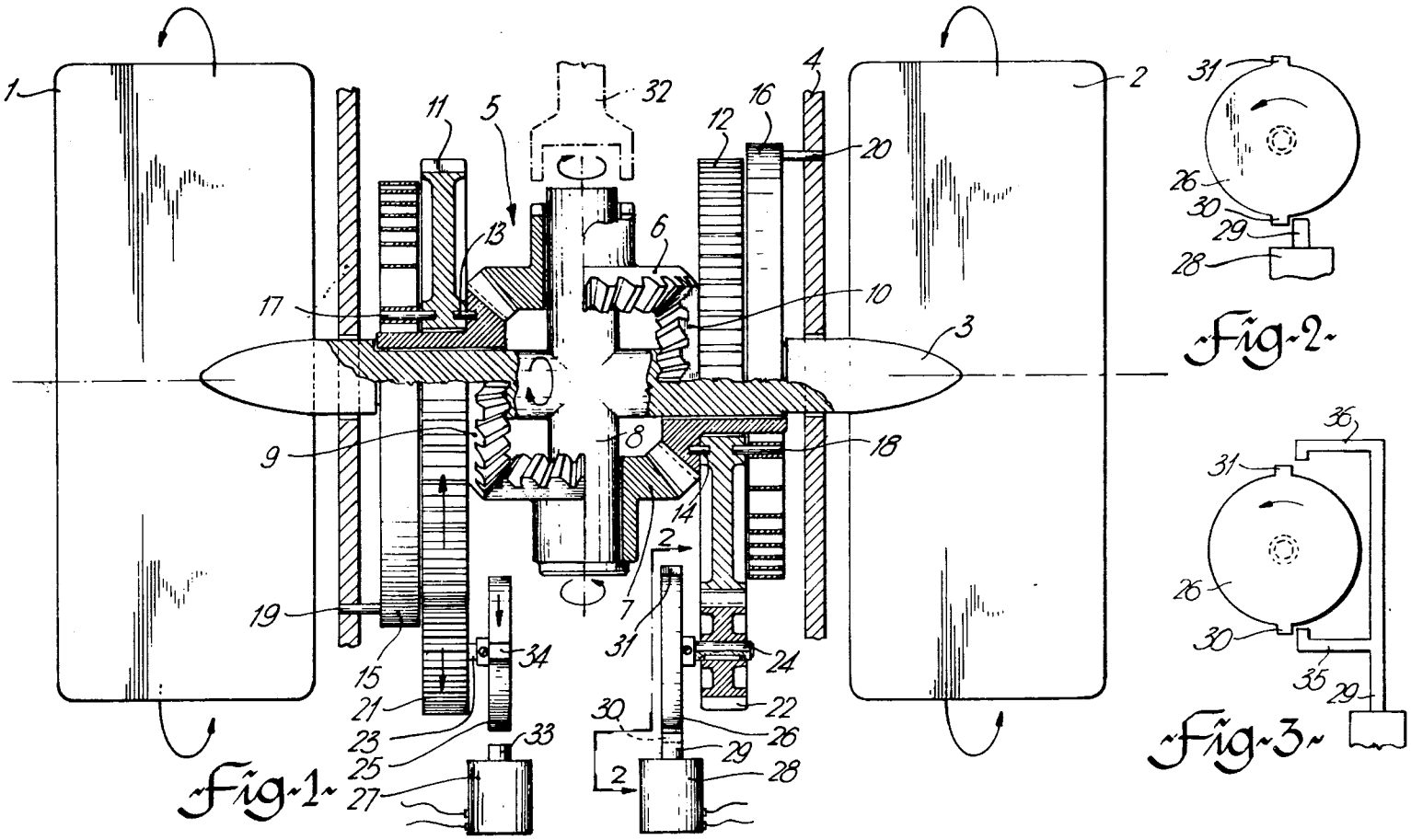
FIG. 1 is a plan view, partly in section, of one embodiment of the device of the present invention, with the left hand solenoid actuated.
FIG. 2 is a sectional view, taken along 2—2 of FIG. 1, showing a 2-tooth escapement.
FIG. 3 is a sectional view of an alternative 2-tooth escapement.

In FIG. 1 there is shown a spring-actuated two-vane device for a guided weapon guidance system.

Control vanes 1 and 2 are rigidly mounted, in the same plane, at opposite ends of an axially rotatable shaft 3, externally and on opposite sides of a housing 4 (shown in part in FIG. 1) through which shaft 3 is mounted. Within the housing 4 there is provided a 4-bevel gear differential mechanism shown generally as 5. A first pair of equal-bevel gears 6 and 7 are rotatably mounted on a shaft 8 which is normal to and solid with shaft 3. A second set of equal-bevel gears 9 and 10 are rotatably mounted on shaft 3 and mesh with bevels 6 and 7. Bevels 9 and 10 are rigidly secured to large pinion gears 11 and 12, respectively, which are also axially rotatable on shaft 3, for example by means of pins 13 and 14, respectively. Clearly, pinions 11 and 12 may also be splined or otherwise secured to bevels 9 and 10, respectively. Pinion gears 11 and 12 are provided with opposed axially mounted spiral springs 15 and 16, respectively, which are secured to their respective gears and to the housing 4 by pins 17, 19 and 18, 20, respectively, so as to effect axial rotation in opposite directions. Pinions 11 and 12 mesh with small pinions 21 and 22, respectively, which are axially and rigidly mounted on shafts 23 and 24, respectively. 2-tooth escapements 25 and 26 are rigidly and axially mounted on shafts 23 and 24, respectively and are held in a locked position by low power solenoids 27 and 28, respectively. In FIG. 1 solenoid 27 is shown in the activated or unlocked position and solenoid 28 shown in the deactivated or locked position. As seen more clearly in FIG. 2, the solenoid plunger 29 engages one of the teeth 30, 31 and thus prevents movement of the escapement. Upon momentary activation of the solenoid, the plunger is withdrawn allowing tooth 30 to escape and the escapement to rotate 180°, under the action of spring 15, before tooth 31 engages the re-extended plunger 29. Solenoid 27 and escapement 25 are designed to operate in precisely the same manner but in the opposite direction. It will be appreciated that solenoids 27 and 28 may be activated independently as required by any convenient control mechanism (not shown). An alternative form of escapement is illustrated in FIG. 3 in which plunger 29 is provided with two arms 35, 36 on opposed sides of escapement 26 so that in the rest position arm 35 engages tooth 30. Upon actuation of solenoid 28, arm 35 releases tooth 30 but simultaneously arm 36 is also drawn downwardly to a position in which it can engage tooth 30 as it rotates round thereby ensuring that escapement 26 cannot rotate more than the desired 180° before again reaching a stop. It has been found that this device is so sensitive to minor movements that an escapement as in FIG. 3 is highly desirable.

In operation, both solenoids are first activated to release the escapements and the springs 15 and 16 fully tensioned by winding with a special key 32 (shown in skeleton in FIG. 1) applied to one of the bevels. When the opposed springs 15 and 16 are fully wound the solenoids 27 and 28 are deactivated thus locking the system. In an alternative embodiment, if the escapements are so designed that the solenoids lock only in the usual direction of motion, i.e. in the manner of a ratchet effect when not energized, the springs 15 and 16 may be tensioned without energizing the solenoids. In another alternative embodiment it has been found convenient to interpose a second gear stage, ending with a "snail" escapement (not shown) so as to provide a convenient and alternative point at which to wind the springs.

When, after tensioning the springs, solenoid 27 is momentarily activated, as shown in FIG. 1, while retaining solenoid 28 in the deactivated condition, plunger 33 disengages from the tooth engaged therewith (not shown) and, under the action of spring 15, the escapement 25 rotates anticlockwise through 180° until tooth 34 engages the now extended plunger 33. Rotation of escapement 25 causes a similar rotation in small pinion 21 and a corresponding clockwise rotation in large pinion 11.

A preferred large/small pinion ratio is about 10:1 although of course this is merely a matter of desin and is not critical to the invention. With the preferred 10:1 ratio the rotation of pinion 11 will be 18°. Bevel 9 moves with the large pinion 11 in a clockwise direction, in the manner of a driver and because bevel gear 10 is fixed or locked by escapement 26, the meshing bevels 6 and 8 (the planet cage) will rotate 9° around the stationary gear 10, in accordance with the standard motion relationship associated with a differential gear system, thus inclining shaft 3 and its associated vanes 1 and 2 9° in the direction shown by the arrows in FIG. 1.

As previously indicated, spring 16 is opposed to spring 15 so that, when solenoid 28 is actuated releasing escapement 26 one pulse or 180°, the vanes are returned to the neutral position and a further pulse will effect a further 9° movement in the opposite direction to that shown in FIG. 1. Operation of either solenoid can be repeated as desired until the springs 15 and 16 are unwound.

It will be appreciated that many modifications may be made to the preferred embodiment described hereinabove without departing from the scope of this invention. For example, in some applications it may be advantageous to provide an automatic return to neutral after a preset time interval and means to effect this return may easily be incorporated into the solenoid control device. Means for still further reducing the power demand of the system, which is already much lower than that of the prior art, may also be incorporated, for example by interposing a condenser which is charged between pulses.

Figure 5:
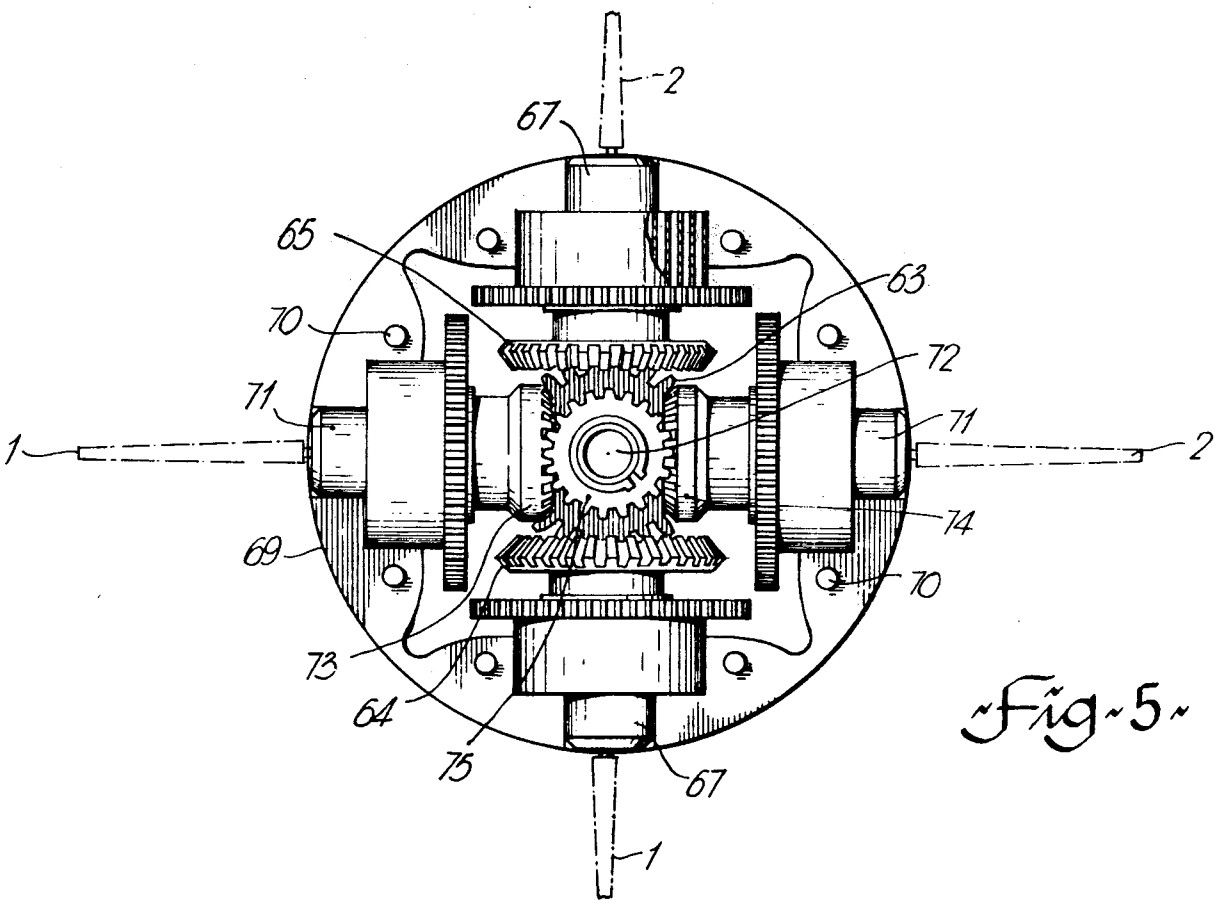
FIG. 5 is a sectional view taken along 5—5 of FIG. 4.
Figure 6B:
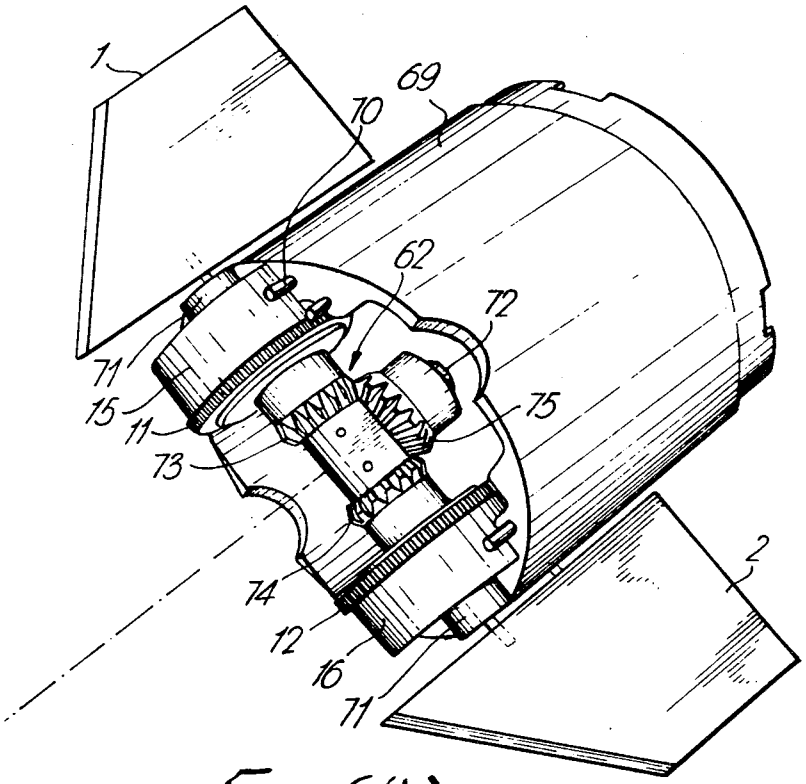
Figure 6A:
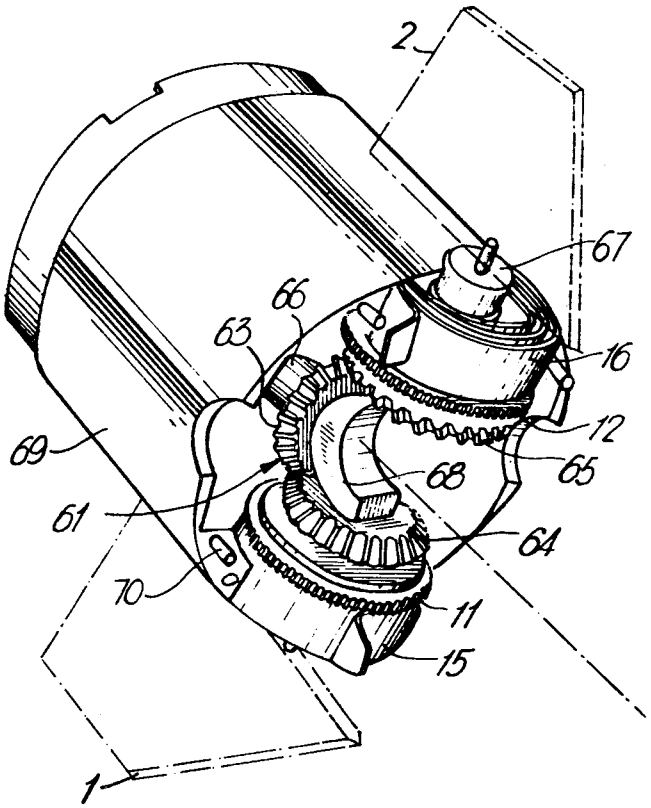

As previously indicated this invention is particularly suitable for use in a guided weapon guidance system, which normally requires two sets of vanes at right angles to each other and this can be achieved either by providing two devices as shown in FIG. 1 at right angles or by nesting two slightly modified forms of the device as illustrated in FIGS. 4 to 6. It has been found that in a guided weapons sytem only about 9° movement in each direction is required in the vanes and it is, therefore possible to nest two of the mechanisms of FIG. 1 by using suitably sized gear sets, modified as shown most clearly in FIG. 6. FIG. 4 shows the assembled nested unit and FIGS. 6*a* and 6*b* show the unit in exploded form. The 4-gear differential mechanism 5 of FIG. 1 is modified in FIGS. 4 to 6 to provide two 3-gear differential mechanisms 61 and 62 which nest at right angles one within the other. As seen most clearly in FIG. 6, mechanism 61 comprises three relatively large intermeshing gears 63, 64 and 65 mounted on rigidly interconnected shafts 66 and 67 respectively. Shaft 67 is provided with a central U-shaped portion 68 so as to form a yoke. Mechanism 61 is located within one half of housing 69 which also contains the escapement and power source (not shown). Springs 15 and 16 are mounted on shaft 67 together with pinions 11 and 12 as described with reference to FIG. 1. Pins 70 are preferably provided to locate the two halves of housing 69 and vanes 1 and 2 are provided on shaft 67. Similarly mechanism 62 is housed within a second half of housing 69 and provided with rigidly interconnected shafts 71 and 72. Vanes 1 and 2, springs 15 and 16 and pinions 11 and 12 are also provided as hereinbefore described. Mounted on shafts 71 and 72 are three interengaging relatively small sized gears 73, 74 and 75 respectively forming the differential mechanism 62. Gears 73, 74 and 75 are sized so as to nest inside gears 64, 65 and 66, as seen more clearly in FIG. 5. The central portion 76 of shaft 71 is shaped so as to fit loosely within the yoke 68 of shaft 67 and permit movement of up to about 9° on each side of a neutral plane for each pair of vanes 1, 2.

In operation the device of FIGS. 4 to 6 is precisely the same as that described with reference to the device of FIG. 1 except of course that each of the two mechanisms 61 and 62 is controlled by its own individual escapement. Movement is restricted to about 9° on each side of neutral by reason of machining tolerances for the nesting arrangement but for practical purposes in a weapons guidance system this has been found to be adequate.

It will be appreciated that this invention is also equally applicable in other applications, systems and environments. For example, and without limitation, the present mechanism could equally well be applied to a single vane system and with relatively minor modifications could be designed so that, in a two-vane system, the vanes operate in opposite directions. The mechanism could also be employed to control one or more valves in a pipeline system, for example in the manner of a conventional butterfly valve in a carburetor choke device. Although coil springs are the preferred power source for actuating the pinions, it will be appreciated that other power sources such as air of hydraulic motors or cylinders of electromagnetic devices could be employed, in which case it may be possible to employ only a single motor which could be reversed to effect motion of the vane in the opposite direction. Similarly, geared pinions represent only a preferred embodiment and could be replaced by friction devices and the like, well known to those skilled in the art.

The embodiments of the invention in which an exclusive property or prvilege is claimed are defined as follows:

1. A device for controlling the angular position of a vane comprising:

(a) a first shaft, (b) a second shaft normal to and solid with said first shaft;

(c) a vane secured adjacent one end of said first shaft;

(d) a differential gear arrangement having a pair of gears rotatably mounted on said first shaft and at least one gear meshing with said pair of gears and rotatably mounted on said second shaft;

(e) drive means drivingly connected to one gear of said pair of gears;

(f) motor means drivingly connected to said drive means to drive the same;

(g) means selectively operable to effect incremental movement of the drive means; and (h) brake means associated with the second gear of said pair of gears to arrest the same, whereby incremental movement of said drive means causes a change in the angular position of said vane.

2. A device as claimed in claim 1 including:

(i) a second drive member operatively connected to said second gear of said pair of gears; and (j) second motor means drivingly connected to said second drive member to drive the same.

3. A device as claimed in claim 2 wherein said motor means and said second motor means are adapted to drive said first and second drive means in opposite angular directions.

4. A device as claimed in claim 3, wherein said motor means are spring means.

5. A device as claimed in claim 1 including a second vane secured adjacent the other end of said first shaft.

6. A device as claimed in claim 1 wherein a pair of gears are rotatably mounted on said second shaft and mesh with said pair of gears mounted on said first shaft.

7. A device as claimed in claim 1 wherein said drive means is a pinion gear.

8. A device for controlling the angular position of a vane comprising:

(a) a first shaft;

(b) a second shaft normal to and solid with said first shaft;

(c) a vane secured adjacent one end of said first shaft;

(d) a differential gear arrangement having a first pair of gears rotatably mounted on said first shaft and a second pair of gears meshing with said first pair of gears and rotatably mounted on said second shaft;

(e) a pair of drive means each drivingly connected to a respective gear of said first pair of gears;

(f) a pair of motor means each drivingly connected to a respective said drive means to drive the same;

(g) a pair of driven means each operatively connected to a respective said drive means and to a respective remotely actuable escapement so as to effect incremental movement of a selected one of said driven means while arresting movement in the other said driven means, to thereby effect an incremental movement in one of said drive means and cause a change in the angular position of said vane.

9. A device as claimed in claim 8 wherein each said drive means is a pinion gear and each said driven means is a pinion gear meshing with a respective drive means.

10. A device as claimed in claim 9 wherein the gear ratio between each said drive means and its respective driven means is 10:1.

11. A device as claimed in claim 8 wherein each said escapement comprises a two-tooth escapement axially mounted with a respective said driven means.

12. A device as claimed in claim 8 including a pair of solenoid means each remotely selectively actuable for movement between a first position in arresting engagement with a respective said escapement and a second position permitting incremental movement of said respective escapement.

13. A device as claimed in claim 12 wherein each said escapement is a two-tooth escapement axially mounted with a respective said driven means.

14. A device as claimed in claim 12 wherein each said motor means comprises a spring means, each mounted on a respective said drive means so as to drive said pair of drive means in opposite angular directions.

15. A device as claimed in claim 8 including a second vane means secured adjacent the other end of said first shaft.

16. A device as claimed in claim 8 wherein each said motor means comprises a spring means.

17. A device as claimed in claim 8 wherein each said motor means comprises a coil spring means, each said spring means being operatively connected to a respective said drive means to drive said pair of drive means in opposite angular directions.

18. A device as claimed in claim 17, including means for simultaneously winding said coil springs in opposed directions when each said escapement is in a position permitting movement in each said drive means.

19. A device as claimed in claim 18 wherein said means for winding said coil springs comprises key means adapted to engage one of the gears of said second pair of gears.

20. A device for controlling angular position of a vane comprising:

a first shaft;

a vane secured adjacent each end of said first shaft;

a second shaft normal to and solid with said first shaft;

a first pair of bevel gears rotatably mounted on said first shaft;

a second pair of bevel gears rotatably mounted on said second shaft and meshing with said first pair of bevel gears so as to provide a differential;

first and second pinion gears axially mounted on said first shaft, each abutting a respective bevel gear of said first pair of bevel gears and rotatable therewith;

spring means operatively connected to said first and second pinion gears to effect rotation thereof in opposite angular directions; axially mounted first and second escapement means;

third and fourth pinion gears axially mounted and rotatable with said first and second escapement means respectively and meshing with said first and second pinion gears, respectively; and solenoid means adjacent each said escapement means for selective engagement with and release from a respective escapement to thereby permit incremental movement of a selected one of said first and second pinion gears and thus cause a change in the angular position of said first shaft and its associated vane.

21. A device for controlling the angular position of at least two vanes mounted at right angles in the same axial plane, comprising: first and second vane control mechanisms adapted to be contained within a single housing, each said mechanism comprising:

(a) a first shaft;

(b) a second shaft normal to and solid with said first shaft;

(c) a vane secured adjacent at least one end of said first shaft;

(d) a differential gear arrangement having a pair of gears rotatably mounted on said first shaft and a gear meshing with said pair of gears and rotatably mounted on said second shaft;

(e) drive means drivingly connected to at least one gear of said pair of gears;

(f) motor means drivingly connected to each said drive means to drive the same;

(g) means selectively operable to effect incremental movement of the drive means; and (h) brake means associated with the second gear of said pair of gears to arrest the same, whereby incremental movement of said drive means causes a change in the angular position of said vane;

wherein said first shaft of said first mechanism includes a U-shaped recess between said pair of gears mounted thereon and said first shaft of said second mechanism includes a U-shaped portion between said pair of gears mounted thereon adapted for a loose abutting relationship in said U-shaped recess when said first shafts of said first and second mechanisms are at right angles to each other, thereby permitting limited angular relative movement, at right angles between said first and second mechanisms, and wherein said gears of said second mechanism are relatively smaller than said gears of said first mechanism such that said gears of said second mechanism nest within an area bounded by the gears of said first mechanism.

22. A device as claimed in claim 21 including (i) a second drive member operatively connected to said second gear of said pair of gears; and (j) second motor means drivingly connected to said second drive member to drive the same.

23. A device as claimed in claim 22 wherein said motor means and said second motor means are adapted to drive said first and second drive means in opposite angular directions.

24. A device as claimed in claim 23 wherein said motor means are spring means.

25. A device as claimed in claim 21 wherein a second vane is secured adjacent the other end of each said first shaft.

26. A device as claimed in claim 21 wherein said angular relative movement between said first and second mechanisms is up to about 9° on each side of a neutral plane.

27. A device as claimed in claim 21 wherein said means selectively operable and said brake means comprise a pair of driven means each operatively connected to a respective said drive means and to a respective remotely actuable escapement so as to effect incremental movement of a selected one of said driven means while arresting movement in the other said driven means, to thereby effect an incremental movement in one of said drive means and cause a change in the angular position of said vane.

* * * * *